US005934409A

United States Patent [19]

Citron et al.

[11] Patent Number: 5,934,409

[45] Date of Patent: Aug. 10, 1999

[54] TRAILER PERSONNEL LIFT WITH A LEVEL SENSOR AND MANUALLY SET OUTRIGGERS

[75] Inventors: Steven D. Citron, Redmond; Michael F. Davis, Seattle; Matthew G. Kraemer; John Busuttil, both of Redmond, all of Wash.

[73] Assignee: Genie Industries, Inc., Redmond, Wash.

[21] Appl. No.: 08/883,399

[22] Filed: Jun. 26, 1997

[51] Int. Cl.[6] ..... B66F 11/04

[52] U.S. Cl. ..... 182/18; 182/17; 182/2.7

[58] Field of Search ..... 182/18, 19, 2.1–2.11, 182/63.1, 69.4, 69.5, 69.6, 17; 212/301–305

[56] References Cited

U.S. PATENT DOCUMENTS

| | | | |
|---|---|---|---|
| 4,288,196 | 9/1981 | Sutton, II . | |
| 4,597,584 | 7/1986 | Hanser . | |
| 4,746,133 | 5/1988 | Hanser et al. . | |
| 5,143,386 | 9/1992 | Uriarte . | |
| 5,159,989 | 11/1992 | Claxton . | |
| 5,176,391 | 1/1993 | Schneider et al. . | |
| 5,388,662 | 2/1995 | Tranchero | 182/2.9 |

FOREIGN PATENT DOCUMENTS

| | | |
|---|---|---|
| 0321789 | 6/1989 | European Pat. Off. . |
| 2184554 | 12/1973 | France . |
| 2552463 | 3/1985 | France . |
| 19505703 | 6/1996 | Germany . |
| 59-106351 | 6/1984 | Japan . |
| 60-092145 | 5/1985 | Japan . |
| 08133677 | 5/1996 | Japan . |
| 1508605 | 4/1978 | United Kingdom . |
| 2094261 | 9/1982 | United Kingdom . |

*Primary Examiner*—Alvin Chin-Shue
*Attorney, Agent, or Firm*—Christensen O'Connor Johnson & Kindness, PLLC

[57] ABSTRACT

A trailer personnel lift (20) with a level-sensing system (69). The level-sensing system (69) provides information to a level-indicator display (72) that indicates which outriggers (34) of the trailer personnel lift (20) need to be lowered. Upon lowering of the designated outriggers (34), the signal for the outrigger (34) changes so as to indicate that the outrigger (34) no longer needs lowering. The outriggers (34) are capable of locking into at least three positions, a first position (40A) in which the outrigger (34) extends substantially horizontal to the surface upon which the personnel lift (20) is to be located, a second position (48A) in which the outrigger (34) extends substantially vertically from the base, and a third position (46A) that is intermediate of the first and second positions, the third position being selected so that the outriggers (34) may be stabilized in the third position (46A) on an upward slope.

19 Claims, 10 Drawing Sheets

TRAILER PERSONNEL LIFT WITH A LEVEL SENSOR AND MANUALLY SET OUTRIGGERS

FIELD OF THE INVENTION

This invention is directed to a trailer personnel lift and, more specifically, to a trailer personnel lift incorporating manually set outriggers.

BACKGROUND OF THE INVENTION

Personnel lifts are used for a wide variety of applications. A typical personnel lift includes a work platform that can be raised or lowered to position a worker at a desired height. The work platform and the worker can be raised to a position where the worker can paint overhead surfaces, trim tree branches, or work on overhead fixtures, for example.

Recently, personnel lifts have become a popular rental item. Rental provides a relatively inexpensive way for an individual or company to use a personnel lift for a short period of time. The user does not have to store the personnel lift, and is not responsible for periodic maintenance of the personnel lift.

Personnel lifts can be bulky and large, and transporting a rented personnel lift to a work site may be difficult. Often, with larger personnel lifts, the rental of a truck or other transportation vehicle to move the rented personnel lift to a work site may exceed the cost of rental of the personnel lift.

To aid in mobility, and decrease the cost thereof, manufacturers have recently started providing personnel lifts on trailers. For ease of reference, the trailer-mounted personnel lifts will hereinafter be referred to as "trailer personnel lifts." A trailer personnel lift may be towed behind a vehicle with a conventional trailer hitch. Once the trailer personnel lift is towed to the work site, the personnel lift is ready for stabilization, leveling, and use.

A trailer personnel lift typically employs four outriggers at the right front, left front, right rear, and left rear of the device for stabilizing the trailer personnel lift. On most prior art trailer personnel lifts, outriggers are manually lowered to stabilize the personnel lift. A simple tilt sensor, such as a pendulum-based electronic sensor, is used to determine whether the trailer is level and provide a lockout that prevents the operation of the personnel lift until the trailer is level. The pendulum-based electronic sensor consists of a disk that is suspended by a cable into a vertically oriented cylinder. If the disk contacts one side of the cylinder, the sensor indicates that the trailer is not "level". The pendulum-based sensor, however, does not indicate the direction in which the trailer is leaning. Instead, leveling bubbles are provided between the outriggers that indicate the direction of trailer tilt. Using the leveling bubbles and the pendulum-based electronic sensor, workers adjust the outriggers on the trailer until the trailer is level.

There are several problems with the leveling system that utilizes a pendulum-based electric sensor and bubble levels. As discussed above, a pendulum-based sensor does not indicate the direction in which a trailer is leaning. Leveling a trailer may be difficult because the individual bubble levels can only indicate level along one axis. Operators often attempt to level a trailer by eye-balling two or more bubble levels. Unfortunately, bubble levels are not very accurate and are often confusing to an untrained operator. In addition, "level" on the bubble levels and "level" on the tilt sensor may not correspond.

Further, as noted above, a pendulum-based electronic sensor does not indicate how level a trailer is, only that the trailer is not level. During setup, an operator can adjust the outriggers such that while the pendulum-based electronic sensor indicates that the trailer is level, the pendulum is not centered in the cylinder. Rather, the pendulum is nearer one side of cylinder than the other sides. During operation of the personnel lifts, a slight shift of the trailer may cause a pendulum near one side of the hanging cylinder to come into contact with that side. Due to its lockout function, such contact will disable the lifting system of the personnel lift. Specifically, the "up" function for the work platform will be shut down. Some models also shut down all functions, which leaves an operator stranded on the aerial work platform until a worker is available at ground level to re-level the trailer by adjusting the outriggers, or manually lower the operator by using a set of override controls located at the base.

Thus, there exists a need for a new and improved leveling system for a trailer personnel lift. The leveling system should be capable of determining how level the personnel lift is, so that slight shifts of the trailer personnel lift during operation will not cause the personnel lift to shut down.

SUMMARY OF THE INVENTION

In accordance with the present invention, a level-sensing system that displays instructions for manipulating manually-set outriggers so as to level a personnel lift is provided. The personnel lift includes a base and a vertical lift assembly defining upper and lower ends, the lower end being attached to the base. An aerial work platform is attached to the upper end of the vertical lift assembly. The personnel lift includes a lift system for extending the vertical lift assembly and raising the aerial work platform. A plurality of manually-set outriggers are provided for stabilizing the base. The level-sensing system determines the magnitude and direction of tilt of the personnel lift and, based on that magnitude and direction information, determines which of the plurality of outriggers needs to be changed in elevation so as to level the personnel lift. A level-indicator display is linked to the level-sensing system. The level-indicator display includes a plurality of indicators corresponding to the plurality of outriggers, the indicators displaying a first signal if the corresponding outrigger needs an elevation change and a second signal if the outrigger does not need an elevation change.

In accordance with further aspects of this invention, an elevation change is a lowering of the outriggers.

In accordance with other aspects of this invention, the personnel lift is mounted on a trailer.

In accordance with yet another aspect of this invention, the level-indicator display includes a representation of the personnel lift.

In accordance with still another aspect of this invention, the number of outriggers is preferably four.

In accordance with another aspect of this invention, the level-sensing system comprises a tilt sensor and a microprocessor. Preferably, the tilt sensor is a dual axis, signal-conditioned tilt sensor.

In accordance with still another aspect of this invention, the outriggers are capable of locking into at least three positions, a first position in which the outrigger extends substantially horizontal to the surface upon which the personnel lift is to be located, a second position in which the outrigger extends substantially vertically from the base, and a third position that is intermediate of the first and second positions, the third position being selected so that the outriggers may be stabilized in the third position on an upward slope.

In accordance with yet another aspect of this invention, the second signal must be displayed by all indicators for the lift system to function. The display of the second signal preferably requires the level-sensing system to determine if the level of the personnel lift is within a first range. If so, the lift system is enabled to operate until the level-sensing system determines that the personnel lift is outside of a second range, the second range being greater than the first range.

In accordance with other aspects of this invention, the present invention provides a method of leveling a personnel lift. The method includes providing a personnel lift having a base and a plurality of manually-set outriggers for stabilizing the base. The personnel lift also includes a level-sensing system for determining the magnitude and direction of tilt of the personnel lift and, based on that magnitude and direction information, determining which of the plurality of outriggers needs an elevation change so as to level the personnel lift. A level-indicator display is linked to the level-sensing system. The level-indicator display includes a plurality of indicators corresponding to the plurality of outriggers, the indicators displaying a first signal if the corresponding outrigger needs an elevation change and a second signal if the outrigger does not need an elevation change. The method further includes changing the elevation of the outriggers that correspond to the indicators displaying the first signal until all outriggers display the second signal.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Figure 1:
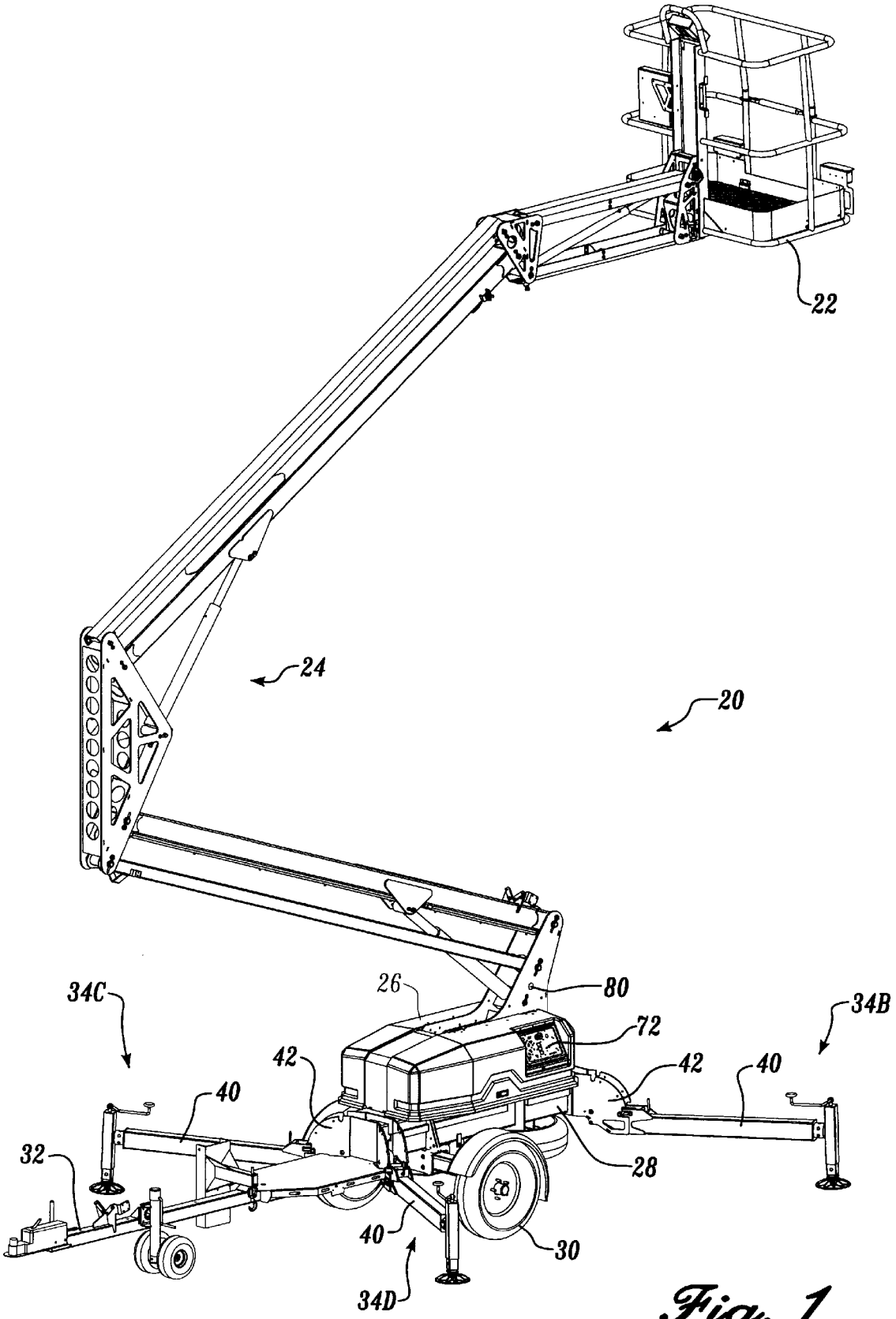
FIG. 1 is a perspective view of a trailer personnel lift embodying the present invention, with the outriggers stabilized and the work platform in a raised position.
Figure 2:
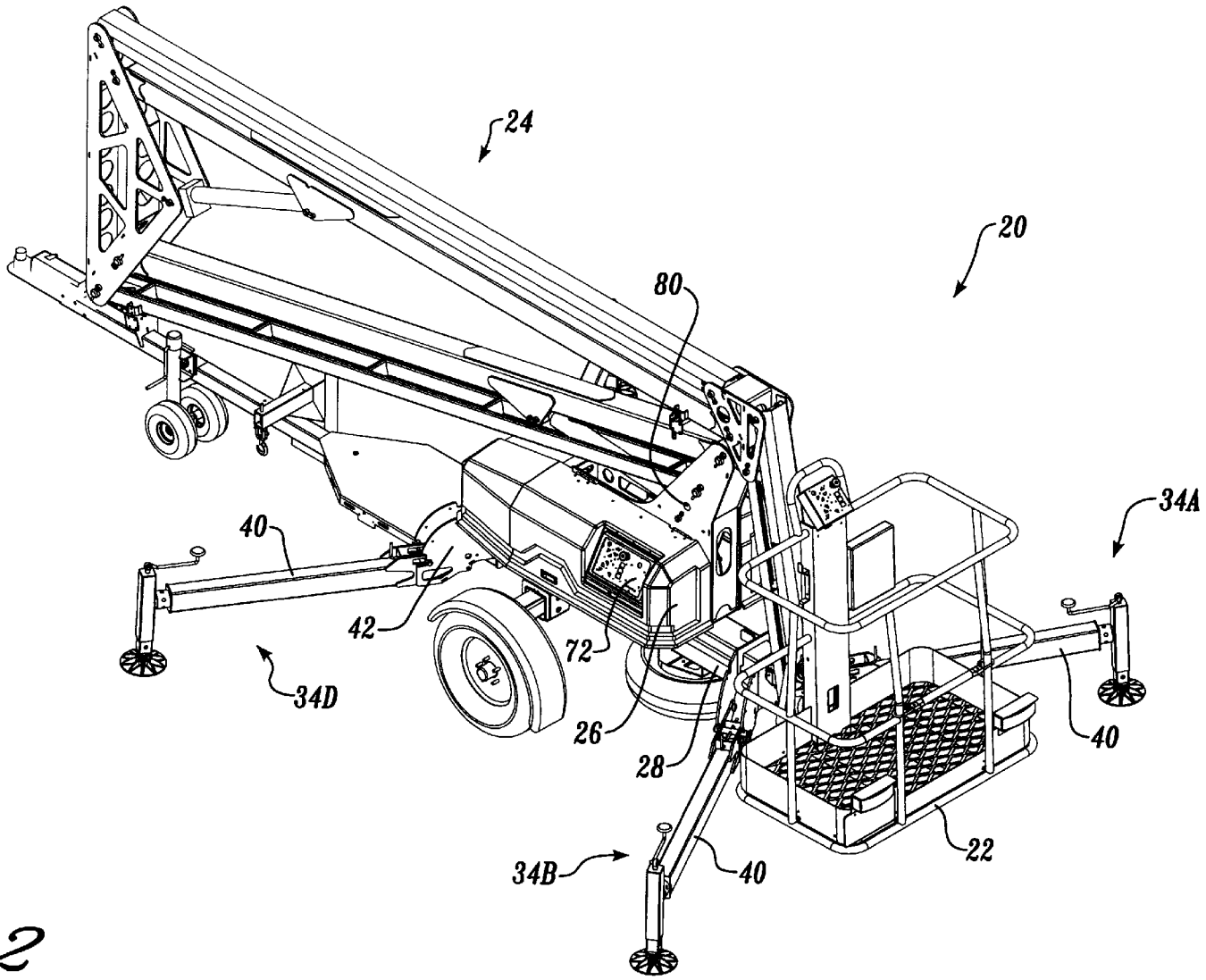
FIG. 2 is a perspective view of the trailer personnel lift shown in FIG. 1, with the work platform in the transport position and the outriggers stabilized.

Referring now to the drawings, in which like reference numerals represent like parts throughout the several views, FIGS. 1 and 2 illustrate a trailer personnel lift 20 embodying the present invention. The trailer personnel lift 20 includes a work platform 22 attached to the upper end of a Z-boom 24. The Z-boom 24 is attached to a turntable 26 that is rotatably mounted on a chassis 28. The chassis 28 includes wheels 30 and a trailer tongue 32. Deployable outriggers 34A–D are attached to the left front, right front, left rear, and right rear corners of the chassis 28.

Briefly described, the trailer personnel lift 20 is designed such that it may be towed by a vehicle coupled to the trailer tongue 32 to a desired location. After reaching the desired location, the outriggers 34A–D are extended, their distal ends brought into contact with the ground and the trailer personnel lift 20 stabilized. The trailer personnel lift 20 is then leveled. After leveling, a worker can enter the work platform 22 and operate controls (not shown, but well known in the art) located on the work platform 22 to energize elements of a lift system (not shown, but well known in the art) that extends the Z-boom 24 to lift the work platform 22.

The operation and structure of the lift assembly and the Z-boom 24 thus described are known in the art. The present invention is directed to a novel outrigger system and a unique leveling system for a trailer personnel lift of the type shown in FIGS. 1 and 2.

The outriggers 34A–D each include fold-up arms 40. The fold-up arms 40 are rotatably attached to the bottom corner of rotary brackets 42 located at the four corners of the chassis 28. Although there are four fold-up arms 40 and, correspondingly, four rotary brackets 42, since all are substantially identical, only one fold-up arm and rotary bracket is described in detail. While it is to be understood that the other three fold-up arms 40 and rotary brackets 42 are similar in construction to the one described and shown in the drawing, they may be arranged slightly differently based on their respective location.

Figure 3:
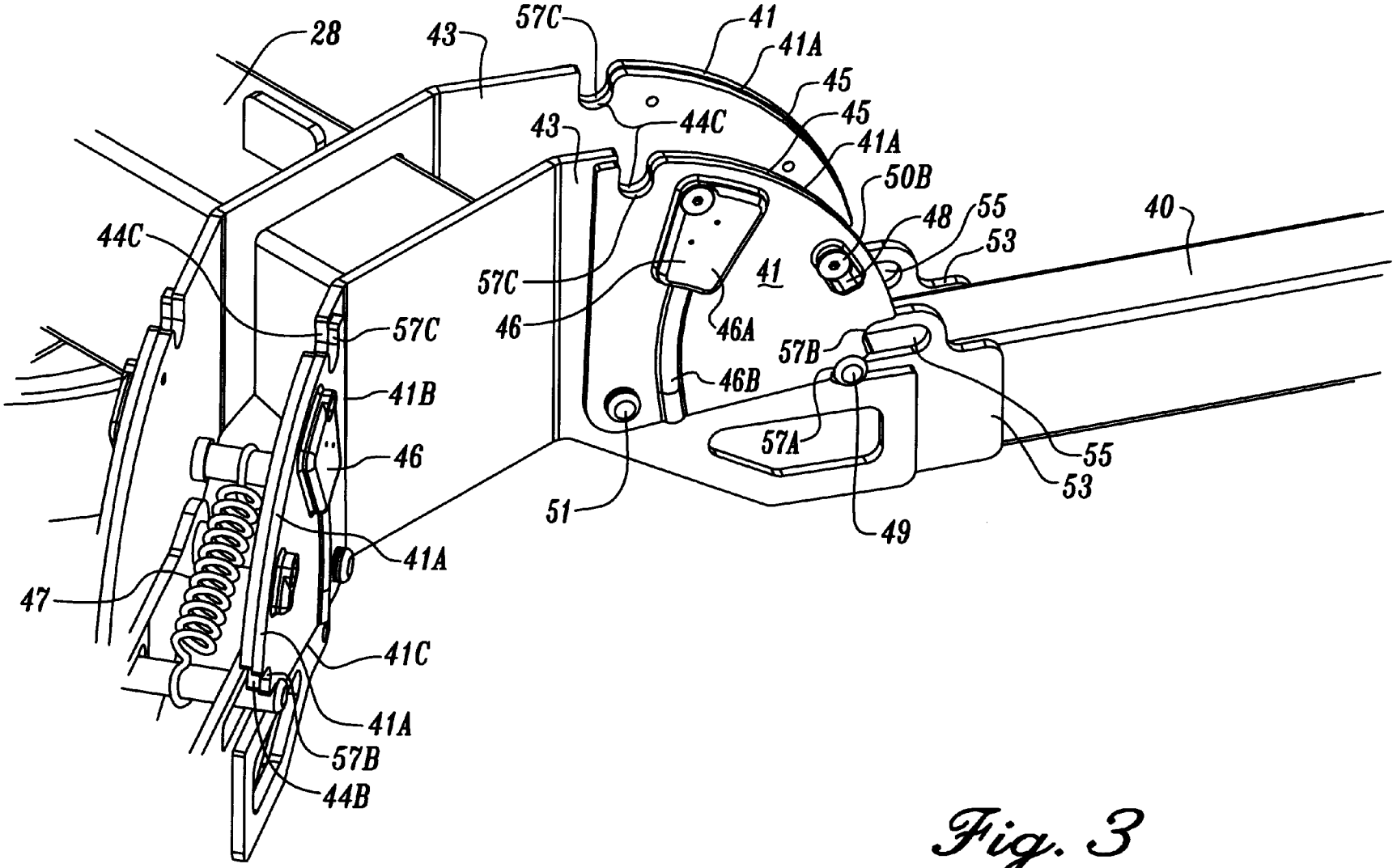
FIG. 3 is a side perspective view of a rotary bracket for one of the outriggers of the personnel lift shown in FIG. 1.

As can best be seen in FIG. 3, the rotary bracket 42 is formed by a pair of reinforced, spaced apart flanges 43 that angle outwardly from the related corner of the chassis 28. The flanges 43 have circular outer peripheral edges 45 that cover an arc of approximately 90°, the center of which is located at a pivot pin 51. The circular outer peripheral edges 45 project upwardly and outwardly. Located in the circular outer peripheral edges 45 are three detent slots 44*a*, 44*b* and 44*c*. The first detent slot 44*a* locks the fold-up arm 40 in a horizontal position; the second detent slot 44*b* locks the fold-up arm 40 at a slight angle to the horizontal, the function of which is described below; and the third detent slot 44*c* locks the fold-up arm in a vertical, transport position.

Reinforced plastic plates 41 extend along the outer faces of the flanges 43. The plastic plates 41 are the shape of a triangle with a circular outer peripheral edge 41*a* and two substantially flat sides 41*b*, 41*c*. The apex of the plastic plates 41 includes holes through which the pivot pin 51 extends. The first flat side 41*b* of the plastic plate 41 extends just outside the third detent slot 44*c*, and the second flat side 41*c* extends to the first detent slot 44*a*. The plastic plates 41 can pivot about the pivot pin 51 between the two orientations shown in FIGS. 5A and 5B. The circular outer peripheral edge 41*a* of the plastic plate 41 substantially matches the contour of the circular outer peripheral edge 45 of the flange 43. The plastic plates 41 include detent slots 57*a*, 57*b*, 57*c* that substantially align with the detent slots 44*a*, 44*b*, 44*c* on the flanges 43. As described in detail below, the upper edges of the detent slots 57*a* and 57*b* are aligned with the upper edges of the detent slots 44*a*, 44*b* when the plastic plate 41 is in the position shown in FIG. 5B.

A hollow, outward projection 46 is located on the outer face of the plastic plate 41. The hollow, outward projection 46 includes an enlarged portion 46*a* and a tail 46*b*. The hollow, outward projection 46 provides a cavity underneath the plastic plate 41 that houses a microswitch 52. The function and mounting of the microswitch 52 is described in detail below. At the upper end of the enlarged portion 46*a* of the hollow, outward projection 46 is an elongate slot 46*c*. The longitudinal axis of the elongate slot 46*c* is substantially aligned with an arc having a center at the pin 51.

A second hollow projection 48 is located on the outer face of the plastic plate 41, spaced from and slightly below the hollow, outward projection 46. The second hollow projection 48 includes an elongate slot 48*a* having a longitudinal axis that is substantially aligned with an arc having a center at the pin 51.

Shoulder bolts 50*a* and 50*b* extend through the elongate slots 46*c*, 48*a* and are threaded into the flanges 43. The flanged heads of the shoulder bolts 50*a* and 50*b* are removed in FIGS. 4, 5A, and 5B so that other details can be seen. The plastic plate 41 is rotatably attached to the pivot pin 51, and the circular outer peripheral edge 41*a* of the plastic plate slides relative to the flanges 43 during pivoting motion of the plastic plate. The contact of the shoulder of the shoulder bolts 50 with the ends of the elongate slots 46*c* limits the rotation of the plastic plates 41 relative to the flanges 43. The function of the movement of the plastic plates 41 is described in detail below.

The fold-up arm 40 is a rectangular tube that includes a pair of flanges 53 located at its inner end. The flanges 53 of the fold-up arm 40 are juxtaposed against the inner sides of the flanges 43 of the rotary bracket 42. The inner ends of the fold-up arm flanges 53 include holes through which the pivot pin 51 extends.

Located along the upper edge (when the fold-up arm is extended) of each of the fold-up arm flanges 53 is a slot 55. Extending between the slots 55 is a lock pin 49. The lock pin 49 extends beyond the outer surfaces of the rotary bracket 42 and is biased by a coil spring 47 (FIG. 4) or other biasing means toward the circular outer edges 45 of the rotary bracket 42. The sizing and spacing is such that if the lock pin 49 is aligned with one of the detent slots 44*a*, 44*b*, 44*c*, the spring 47 pulls the lock pin into the detent slot. The third detent slot 44*c* on the flanges 43 and the first, second, and third detent slots 57*a*, 57*c*, 57*c* on the plastic plates 41 are sized so that the lock pin 49 fits snugly therebetween. The first and second detent slots 44*a*, 44*b* on the flanges 43 are sized so that the lock pin 49 may move side-to-side within the detent slots. Thus, when the lock pin 49 is inserted into the first detent slots 44*a*, 57*a*, or the second detent slots 44*b*, 57*b*, the fold-up arm 40 can be moved slightly upward, which causes the lock pin 49 to move from the bottom of the detent slots 44*a*, 44*b* (FIG. 5A) to the top of the detent slots 44*a*, 44*b* (FIG. 5B), and causes the plastic plates 41 to slide along the outside of the flanges 43.

When the lock pin 49 lies in a detent slot, the fold-up arm 40 is locked in place and prevented from rotating about the pivot pin 51. The strength of the coil spring 47 is such that the lock pin 49 can be manually pulled outward against the biasing force produced by the spring 47 to remove the pin from the detent slots 44*a*, 44*b*, 44*c*. When the lock pin 49 is free of the detent slots, the fold-up arm 40 is free to rotate about the pivot pin 51.

Figure 4:
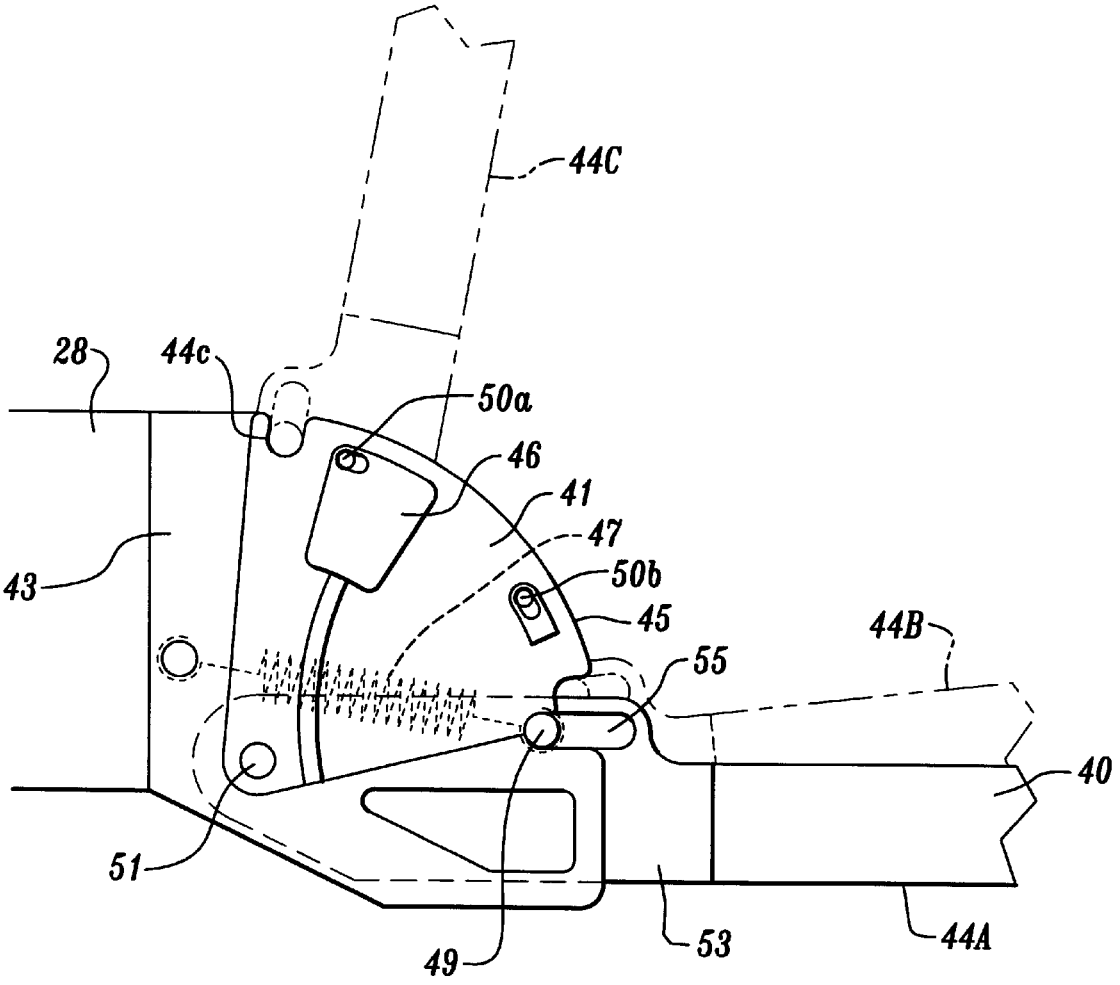
FIG. 4 is a side view of a rotary bracket and fold-up arm of one of the outriggers for the personnel lift shown in FIG. 1, with the fold-up arm shown in horizontal, vertical, and intermediate positions.

When the lock pin 49 is located in the first detent slots 44*a*, 57*a*, the fold-up arm 40 extends substantially horizontal to the ground (shown as position 44A in FIG. 4). When the lock pin 49 is located in the second detent slots 44*b*, 57*b*, the fold-up arm 40 extends at slight angle to the horizontal (shown as position 44B in FIG. 4). When the lock pin 49 is located in the third detent slots 44*c*, 57*c*, the fold-up arm 40 extends vertically (shown as position 44C in FIG. 4). The vertical position is the transport position.

Figure 5A:
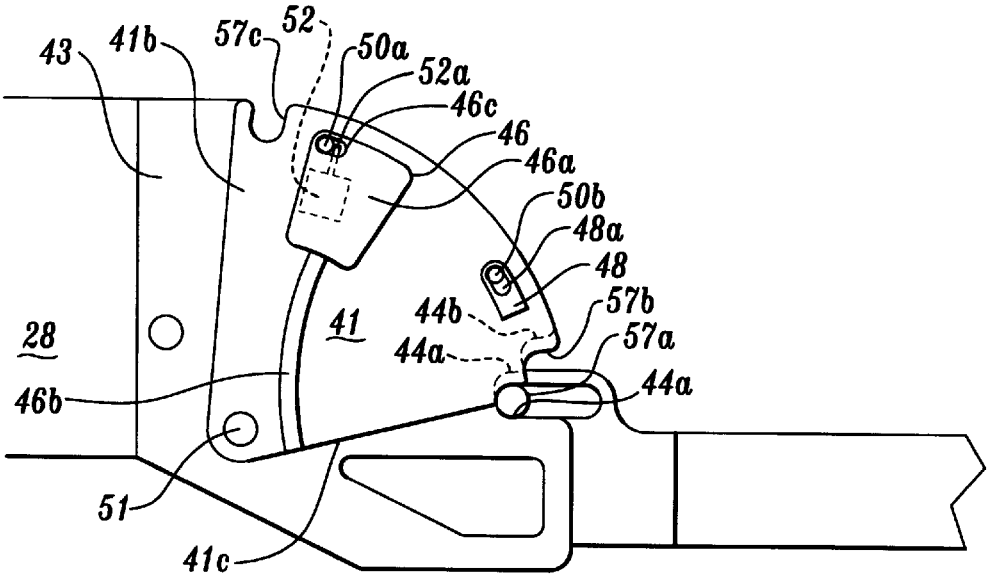
FIG. 5A is a side view of the rotary bracket and fold-up arm of FIG. 4, with a microswitch shown in phantom.
Figure 5B:
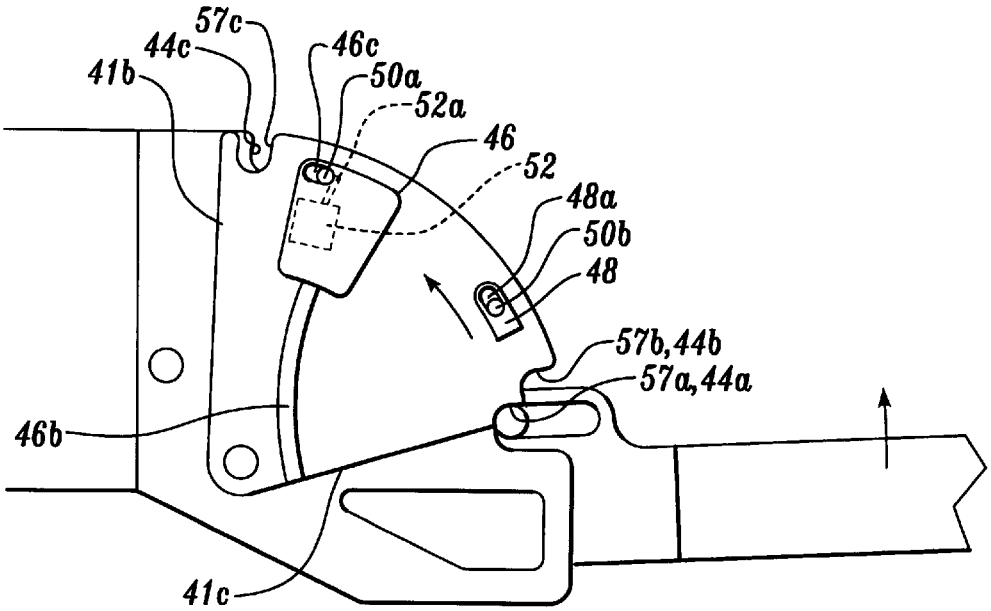
FIG. 5B is a side view of the rotary bracket and fold-up arm of FIG. 5A, with the fold-up arm slightly raised and the microswitch engaged.

As noted above, the plastic plates 41 are mounted on the outside of the flanges 43 of the rotary bracket 42. The microswitch 52 is mounted on the inside of the enlarged portion 46*a* of the hollow, outward projection 46 (FIGS. 5A and 5B). The microswitch 52 includes an arm 52*a* that extends radially outwardly from the direction of the pivot pin 51. The an arm 52*a* is arranged in the path of the shoulder bolt 50 within the elongate slot 46*c*. The wiring for the microswitch 52 extends through the tail 46*b* of the hollow, outward projection 46.

When the lock pin 49 is first inserted into the first or second detent slots 44*a*, 44*b*, a spring (not shown) causes the bottom, second edge 41*c* of the plastic plate 41 to be biased downward. In this biased position, the detent slots 57*a*, 57*b* for the plastic plate 41 are located at the bottom of the detent slots 44*a*, 44*b* of the flanges 43. By pressing upward on the distal end of the fold-up arm 40, the lock pin 49 forces the plastic plate 41 upward against the bias of the spring, causing the elongate slots 46*c*, 48*a* to slide along the shoulder bolts 50*a* and 50*b* and causing the arm 52*a* to engage one of the bolts 50*a*, thereby actuating the microswitch 52. The fold-up arm 40 moves upward as a result of the footpad 60 pressing downward on the ground. In this manner, the microswitch 52 indicates whether the outrigger 34 corresponding to the fold-up arm 40 is engaged with the ground and supporting at least a part of the weight of the trailer personnel lift 20.

Figure 6:
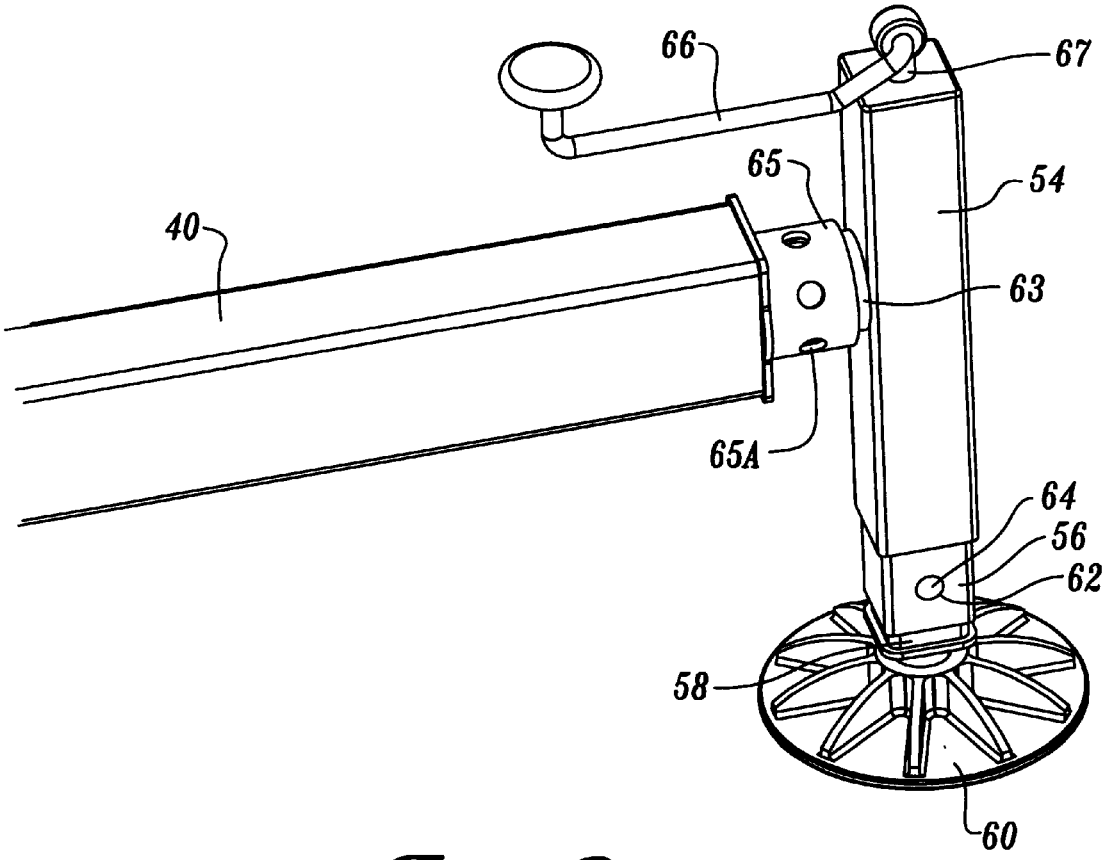
FIG. 6 is a perspective view of a distal end of a fold-up arm and footpad of one of the outriggers of the personnel lift shown in FIG. 1.

Turning to FIG. 6, a footpad tower 54 having a square cross-sectional shape is affixed to the distal end of the fold-up arm 40. A footpad sleeve 56 is slidingly mounted in the footpad tower 54. A post 58 is mounted in the footpad sleeve 56, and a footpad 60 is affixed to the bottom of the post. A hole 62 extends through the footpad sleeve 56 and along the length of the footpad sleeve. A series of holes (not shown, but similar in size to the hole 62 in the footpad sleeve 56) alignable with the hole 62 extend through the post 58 and along the length of the post 58. A peg 64 extends through one set of the holes 62 on the footpad sleeve 56 and a set of the holes on the post 58. The peg/hole combination provides a course footpad elevation adjustment mechanism. More specifically, after the fold-up arm is lowered to either the first or second detent position, the peg 64 is removed. At this time, the footpad sleeve is fully raised by the hereinafter-described elevation mechanism. When the peg 64 is removed, the post drops to the ground. The post is then raised until the hole 62 is aligned with the nearest hole in the post 58. Then the peg 64 is replaced.

The footpad tower 54 is swivelly attached to the fold-up arm 40 so that it can be rotated relative to the fold-up arm 40 and stored in an orientation so that the footpad 60 does not extend outward from the trailer personnel lift 20. To provide this function, a cylindrical sleeve 65 extends axially outwardly from the end of the fold-up arm 40. The cylindrical sleeve includes holes 65A therearound. A cylindrical insert 63 extends axially out of the side of the footpad tower and is received in the cylindrical sleeve 65. The cylindrical insert includes holes (not shown, but similar in size to the holes 65A in the cylindrical sleeve 65) alignable with the holes 65A. A cotter pin (not shown, but well-known in the art) extends through a set of holes 65A on the cylindrical sleeve 65 and a set of holes on the cylindrical insert 63 and prevents rotation of the footpad tower 54 relative to the fold-up arm 40.

A crank 66 is located at the top of the footpad tower 54. The crank is attached to a shaft 67 that is mounted for rotation at the top of the footpad tower 54. The shaft 67 includes threads (not shown, but known in the art) that engage the threads of a nut (not shown, but known in the art) mounted inside of the footpad sleeve 56. Rotation of the crank 66 and shaft 67 causes the nut, and, thus, footpad sleeve 56, to move up or down relative to the footpad tower 54. This rotation mechanism is used to press the footpad 60 against the ground after the course elevation adjustment has been made in the manner described above.

In summary, the invention includes a number of mechanisms that can be used to stabilize the trailer personnel lift on the ground. First, the peg 64 can be removed and the post 58 extended in the footpad sleeve 56 until the footpads 60 lie just above the ground. This eliminates the need for a worker to crank the footpad sleeve 56 a substantial distance in order for the footpad 60 to reach the ground. In addition, reach of the footpad 60 is increased by approximately the length of the post 58.

If the trailer personnel lift 20 is parked on an upward slope, the fold-up arms 40 on the up-slope side lifted until the lock pins 49 extend into the second detent slots 46. This permits the fold-up arms 40 to extend slightly upward from the chassis 28. Preferably, this repositioning causes the fold-up arms 40 to lie substantially parallel to the sloped ground. Thereafter, the peg 64, post 58, footpad sleeve 56, footpad tower 54, and crank 66 mechanisms are used to bring footpads 60 into contact with the ground.

Figure 7:
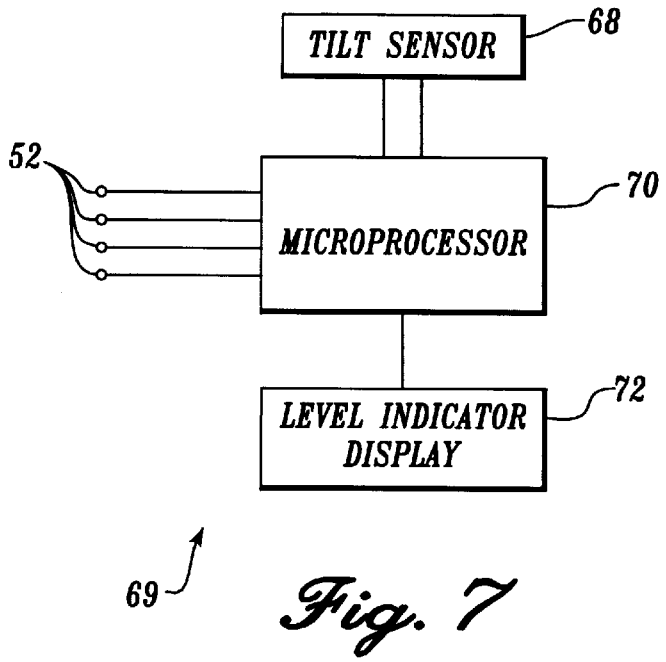
FIG. 7 is a block diagram of the level-sensing system of the personnel lift shown in FIG. 1.
Figure 8:
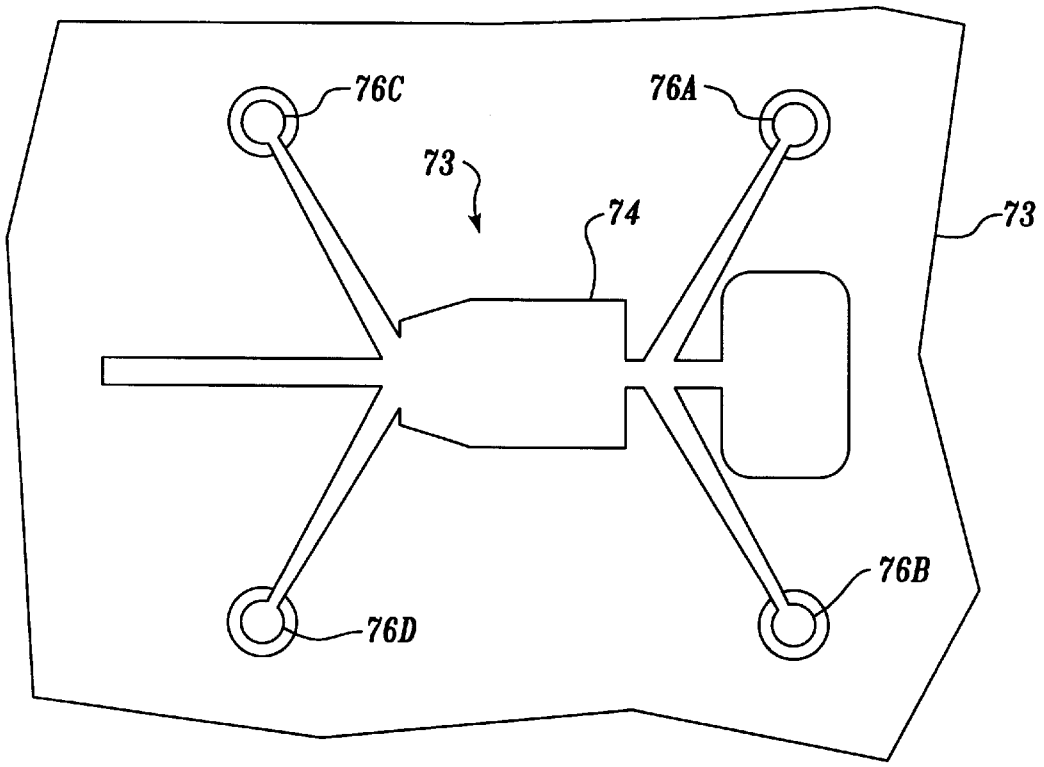
FIG. 8 is a diagrammatic view of a display and control panel suitable for use in the level sensing system shown in FIG. 7.

A block diagram of a level-sensing system 69 for the trailer personnel lift shown in FIGS. 1 and 2 is shown in FIG. 7. The level-sensing system 69 includes a tilt sensor 68 that is mounted on the turntable 26. The tilt sensor 68 is preferably a dual axis, signal-conditioned tilt sensor, such as Model No. AWI1102 sold by Aptek-Williams Company, of Deerfield Beach, Fla. The tilt sensor 68 provides two analog outputs corresponding to the magnitude of tilt along the X- and Y-axes of the tilt sensor. The output information from the tilt sensor 68 is fed to a microprocessor 70. The microprocessor also receives data from each of the microswitches 52 that denotes the open/closed status of the microswitches. For ease of illustration, microprocessor interface circuitry, memory and other required elements, all of which are well known in the art are not shown in FIG. 7. As described in detail below, the microprocessor 70 utilizes the information from the microswitches and the tilt sensor to control the level-indicator display 73 (FIG. 8) level-indicator on the display and control panel 72 to indicate which outriggers need to be lowered to level the personnel lift 20. In addition, the microprocessor 70 utilizes the information from the tilt sensor 68 to determine if the trailer personnel lift is adequately level. If the trailer personnel lift is not adequately level, the "up" function of the lift is disabled. In this manner, the level-sensing system 69 serves as a lock-out device for the trailer personnel lift 20.

The level-indicator display 73 includes a representation 74 of an overhead view of the personnel trailer lift 20. The level indicator display 73 includes four LED's 76A–D, each of which corresponds to one of the outriggers 34A–D on the corners of the trailer personnel lift 20. The analog outputs for the dual-axis tilt sensor 68 range between 0 and 5 volts. If the tilt sensor 68 is level along the X-axis, the rating for the X-axis output will be 2.5 volts. If the tilt sensor 68 is high along one side of the X-axis, the voltage output for the X-axis will be between 5 volts and 2.5 volts. If the opposite side of the X-axis is high, the output will be between 0 and 2.5 volts. The variation from 2.5 volts is determined by the angle of tilt of the tilt sensor 68 along the X-axis. The output for the Y-axis of the tilt sensor 68 corresponds to angle of tilt in a similar manner.

Preferably, the X-axis of the tilt sensor 68 is aligned along the longitudinal axis of the trailer personnel lift 20. The Y-axis extends transversely across the X-axis and parallel to the ground. By positioning the X-axis along the longitudinal axis of the trailer personnel lift 20, each of the outriggers 34A–D are located in separate quadrants of a cartesian coordinate X-Y grid. Each of the quadrants is indicated by the corresponding outrigger number in FIG. 9. The combined X-axis and Y-axis voltage outputs are plotted on the grid in FIG. 9 so that one point represents the two voltage outputs (in terms of angle of tilt) for a particular orientation of the trailer personnel lift 20. For example, if the combined voltage outputs for the X- and Y-axes of the tilt sensor 68 correspond to a point A shown on the grid in FIG. 9, the trailer personnel lift 20 is higher at the corner adjacent to the outrigger 34A, and lower at the corners of the trailer personnel lift corresponding to the other three outriggers 34B–D. As the trailer personnel lift 20 more closely approximates level, outriggers 34B–D, the point representing the combined voltage outputs for the X-axis and Y-axis moves closer to the center L of the grid in FIG. 9.

Figure 10:
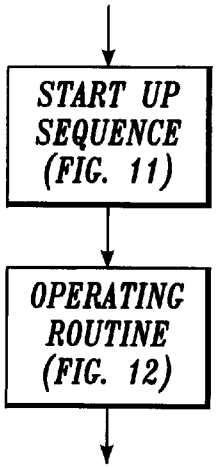
FIG. 10 is a flow diagram displaying the microprocessor operation for the trailer personnel lift of FIG. 1.
Figure 11:
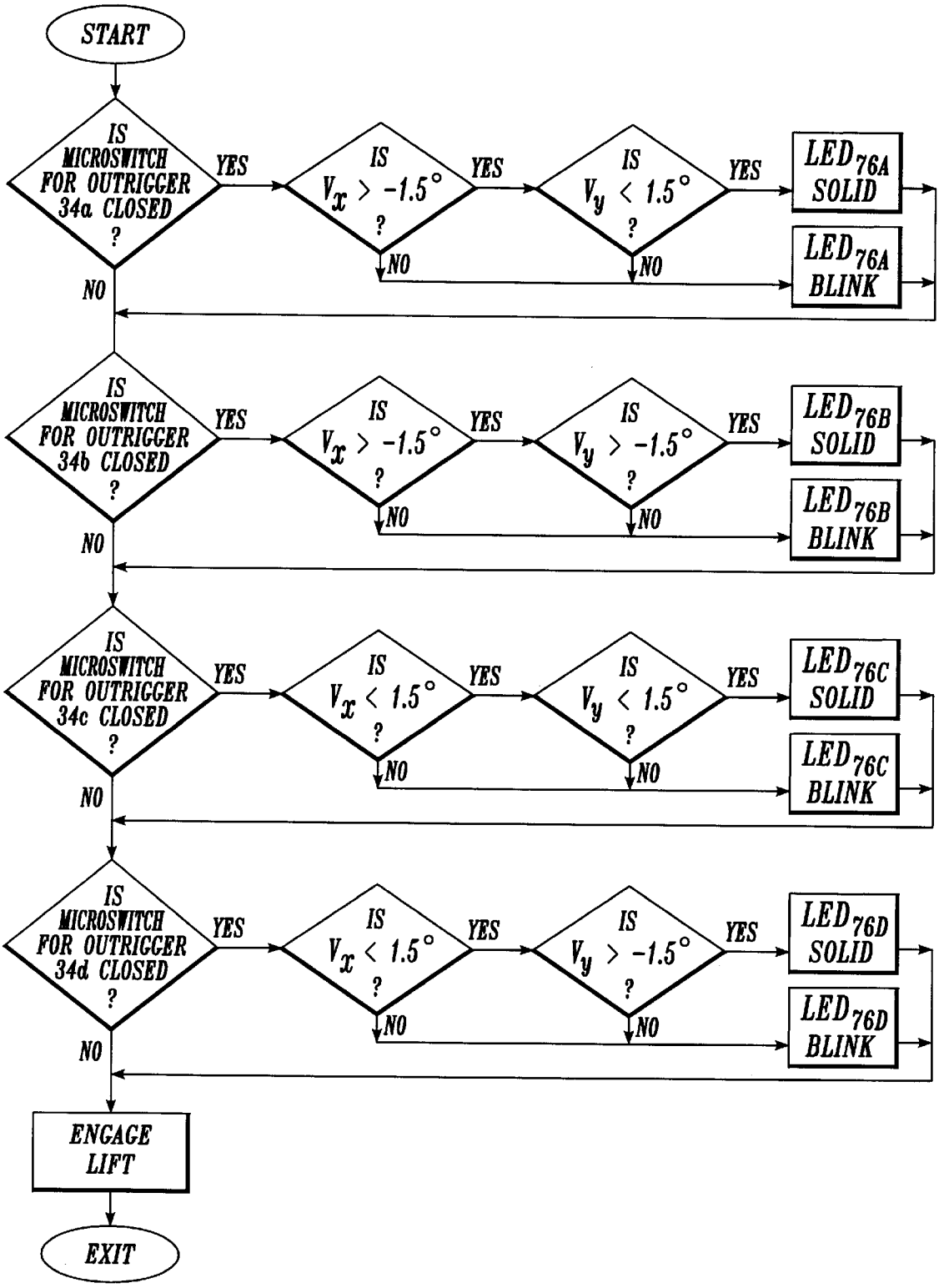
FIG. 11 is a flow diagram displaying the start-up sequence for the trailer personnel lift of FIG. 1.
Figure 12:
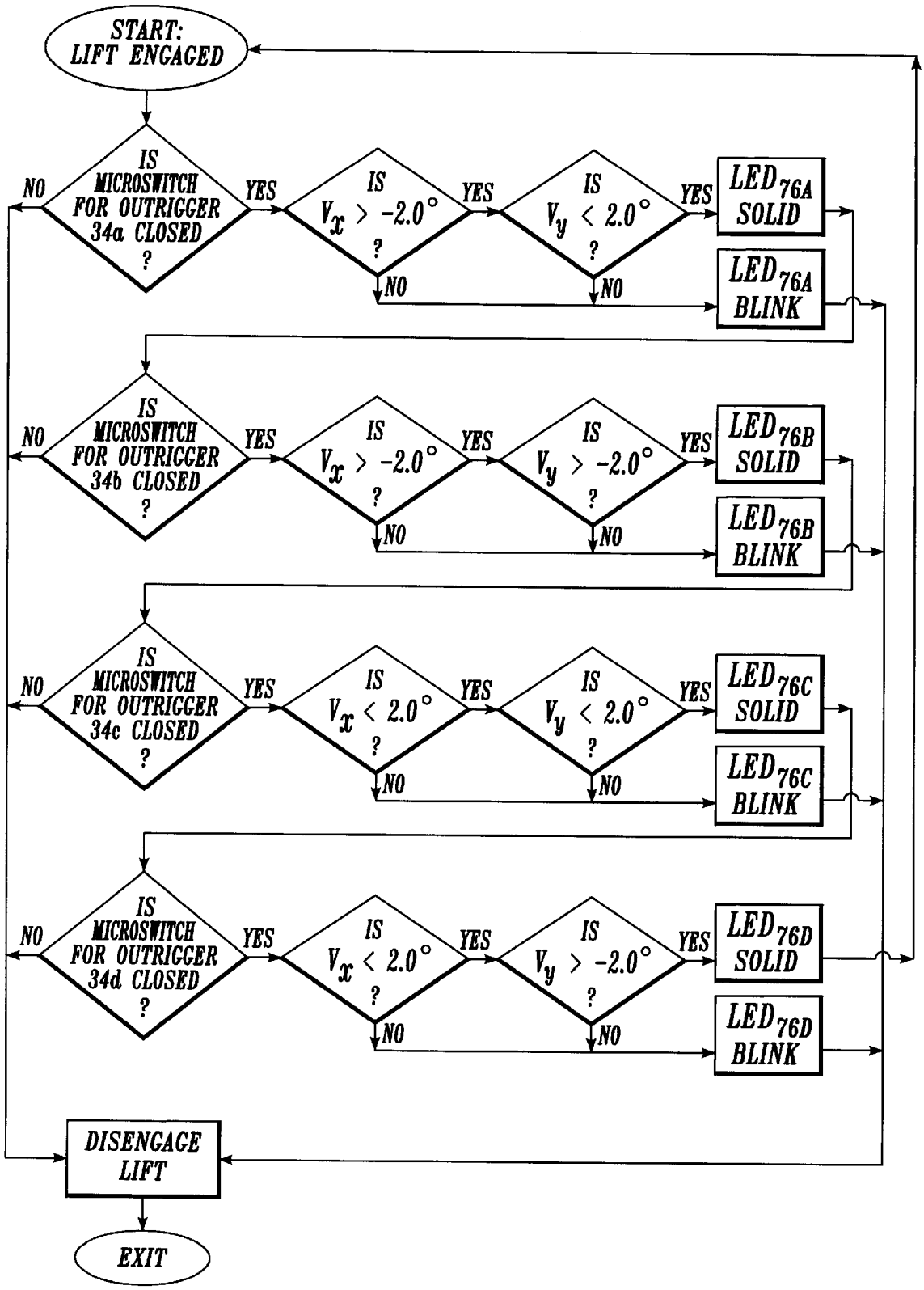
FIG. 12 is a flow diagram displaying the operation routine for the trailer personnel lift of FIG. 1.

Flow diagrams depicting the operation of the microprocessor 70 are shown in FIGS. 10–12. The microprocessor 70 receives the X- and Y-axes' outputs from the tilt sensor 68 and indicates on the level indicator display 73 the low corners of the trailer personnel lift 20. This process is done by establishing a range within which the trailer personnel lift 20 is considered to be "level". In one actual embodiment of the present invention, "level" corresponds to the trailer personnel lift 20 being within ±1.5 degrees of level L along both the X- and Y-axes. If the voltage output for the X- and Y-axes corresponds to an amount outside one or both of the ±1.5 degree ranges for the X- and Y-axes, the LED's 76A–D that correspond to the low corners of the trailer personnel lift blink. The ±1.5 degree range for the X-axis is designated on the grid in FIG. 8 by the area between the dotted lines X (1.5°) and X (−1.5°). Similarly, the "level" range for the Y-axis is designated by the area between the dotted lines Y (1.5°) and Y (−1.5°).

An operation sequence begins by turning on power to the personnel lift 20. At initial set-up, the LED's 76A–D are not lit. The outriggers 34A–D are extended downward and brought into contact with the ground. The LED's 76A–D are switched on by signals sent by the microswitches 52 to the microprocessor 70. As described in detail above, the microswitches 52 indicate that the corresponding outrigger is engaged with the ground and is supporting at least a part of the weight of the trailer personnel lift 20.

The tilt sensor 68 determines magnitude of tilt along the X- and Y-axes of the trailer personnel lift 20 and feeds that information to the microprocessor 70. The microprocessor 70 then causes the proper LED's 76A–D to blink or be solid, to indicate which footpads 60 need to be lowered. In general, the LED's 76 corresponding to the high corners of the trailer personnel lift 20 are solid, and the LED's corresponding to the low corners blink. When all four LED's 76A–D are solid, the trailer is level to within ±1.5 degrees and the "up" function of the work platform 22 is active.

During the start-up sequence (FIG. 11), the microprocessor 70 receives the X- and Y-axes voltage output from the tilt sensor 68 and signals the LEDs 76*a–d* to either blink or remain solid, depending upon the orientation of the trailer personnel lift 20. The microprocessor 70 signals the LEDs 76A–D to be solid if the corner corresponding to the LED is either within the level areas between the dotted lines X(1.5°) and X(−1.5°) (the "level X" region), and Y(1.5°) and Y(−1.5°) (the "level Y" region), or the information from the tilt sensor 68 indicates that the corner is higher than the areas within the level X and Y regions (the "high X" and "high Y" regions for the corner). In order for the LED to be solid, the corner must fall in both (1) the level X region or the high X region and (2) the level Y region or the high Y region. For example, for the LED 76A to be solid, the dot on the grid in FIG. 9 must be located both to the left of the dotted line Y(1.5°) and above the dotted line X(−1.5°) (see the top portion of FIG. 11). Likewise, for the LED 76C to be solid, the dot must be in the region below the line X(1.5°) and to the left of the line Y(1.5°). It can be understood that if the dot lies in the region between the dotted lines X(1.5°) and X(−1.5°) and to the left of the dotted line Y(1.5°), then both the LEDs 76A, 76C will be solid. If the dot falls outside of one or both of the allowed regions for a corner, then the corresponding LED for that corner will blink.

To adjust the trailer personnel lift 20 so that the dot falls within the region between the lines X(1.5°) and X(−1.5°) and Y(1.5°) and Y(−1.5°), the footpads 60 corresponding to the outriggers 34*a–d* on the low corner or corners of the trailer personnel lift 20 are lowered.

Figure 9:
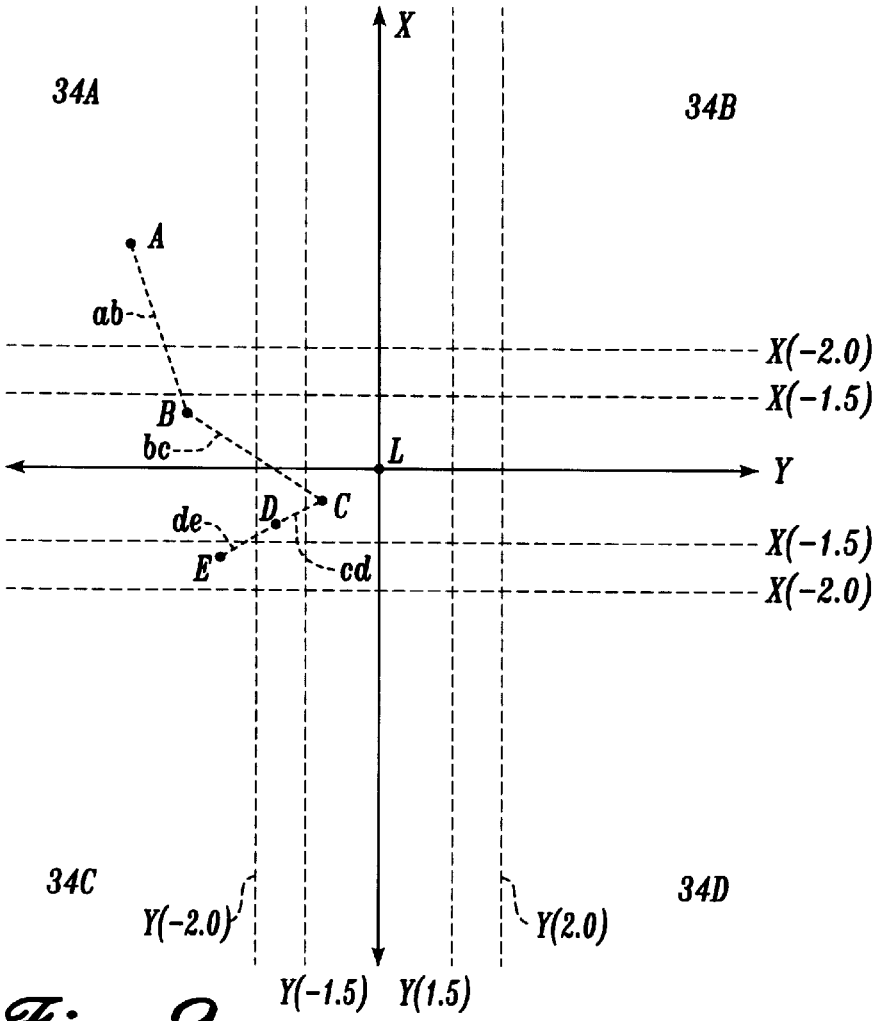
FIG. 9 is a graph displaying how the output voltages along the X- and Y-axes of the tilt sensor of the level sensing system shown in FIG. 7 are interpreted by a microprocessor that controls the display shown in FIG. 8.

An example of various steps in the leveling process is shown in FIG. 9. A trailer personnel lift 20 is stabilized by bringing the outriggers 34A–D into contact with the ground so that the microswitches 52 are switched. As each microswitch 52 is switched "on", the LED 76 corresponding to that outrigger 34 is lit (blinking or solid).

The tilt sensor 68 generates voltage information corresponding to the tilt along the X- and Y-axes. In this example, after stabilization, the voltage outputs for the X- and Y-axes correspond to the point A on the grid in FIG. 9. Thus, the trailer personnel lift 20 is high on the corner corresponding to the outrigger 34A. Therefore, the microprocessor 70 signals the LED 76A corresponding to that corner to be solid. The microprocessor 70 signals the remaining three LED's 76B–D to blink because the point A is not located within either the level or high-side regions for the X- and Y-axes. An operator utilizes the crank 66 on the outrigger 34C so as to raise the corresponding corner of the trailer personnel lift 20. If desired, additional LEDs 80 (FIG. 2) may be provided at each of the corners of the trailer personnel lift 20 so that they may be viewed as the operator is lowering the footpad 60 for the corresponding outrigger 34. The voltage information from the tilt sensor 68 changes during this operation and moves along the line ab to the point B. Once the voltage information has reached the point B, the voltage reading for the X-axis is in the X level region. At point B, the voltage output for the Y-axis is in the high Y region for the outriggers 34A and 34C. Thus, the LEDs 76A, 76C for the outriggers 34A and 34C are solid. The LED's 76B, D continue to blink.

The crank 66 for the outrigger 34D is then rotated to lift the corner corresponding to the outrigger 34D. The voltage information from the X- and Y-axes moves along the line bc to the point C on the grid in FIG. 9. Because the point C is located in the level X region and the level Y region, the trailer personnel lift is considered to be "level", and all of the LED's 76A–D are solid. The "up" function of the work platform 22 is then enabled.

In the operation described above, lowering of the footpads 60 corresponding to the outriggers 34C, 34D may cause the footpad for the outrigger 34B to be lifted from the ground. If this occurs, the microswitch 52 for the outrigger 34B will switch off and the LED 76B will no longer be lit. The footpad 60 for the outrigger 34B is lowered back into contact with the ground until the microswitch 52 is switched "on" and the outrigger 34B is supporting at least a portion of the weight of the personnel lift 20. Continued lowering may be necessary to make all LEDs 76A–D solid. In addition, the contact of the outrigger 34B with the ground may cause the trailer personnel lift 20 to shift, thus changing the output of the tilt sensor 68 and possibly causing one or more of the LEDs 76A, 76C, or 76D to blink. If this occurs, the corresponding outrigger can be lowered as described above. Thus, it is to be understood that leveling of the trailer personnel lift 20 may require one or more adjustments of each of the outriggers 34A–D of the trailer personnel lift.

As shown in the flow diagrams in FIG. 12, the level-sensing system for the trailer personnel lift 20 accommodates for slight shifts in the trailer after leveling. Once the work platform 22 is raised, the "up" function of the work platform continues to function as long as the trailer base is level to within ±2 degrees. The ±2 degrees range is indicated by the region between the dotted lines X (2°) and X (−2°) and Y (2°) and Y (−2°) on the grid on FIG. 9.

As described in detail above, the trailer personnel lift 20 is leveled during the start-up sequence when the tilt sensor produces outputs for the X- and Y-axes that are within ±1.5 degrees of level. When the tilt sensor indicates the trailer personnel lift 20 is level within this range, the "up" function of the work platform 22 is enabled. Occasionally, an operator will enter the work platform 22 and slightly raise the Z-boom 24, and a slight shift of the trailer personnel lift 20 occurs, which causes the trailer personnel lift 20 to no longer be level within ±1.5 degrees. By adding the ±2 degree range described above, the "up" function of the work platform continues to function after the initial leveling as long as the tilt sensor remains level to within ±2 degrees. Thus, in the example described above, the trailer personnel lift may shift along the line cd (FIG. 9) to the point D, and the "up" function remains enabled. However, if the shift continues to the point E, which is more than 2 degrees off of level, the up function for the lift system for the trailer personnel lift is disabled, and can only be reset if the unit is brought back within the ±1.5 degree range. This requires that the work platform 22 be lowered and the trailer personnel lift 20 be leveled as described above.

In the example described above, the trailer personnel lift 20 continues to operate at the position D even though the trailer personnel lift is outside the 1.5 degree range. However, if power is cut to the trailer personnel lift 20, the start-up sequence described above must be followed. Thus, the trailer personnel lift must be brought within ±1.5 degrees of level to begin operation. The trailer personnel lift 20 continues to operate after this initial start-up sequence as long as the trailer is level to within ±2.0 degrees as described above.

In summary, the level sensing system for the trailer personnel lift 20 provides a simple method of manually stabilizing and leveling the trailer personnel lift. An operator is only required to manipulate the outriggers 34*a–d* until each of the LEDs 76A–D on the level indicator display 72 are solid. After that time, the trailer personnel lift is stabilized and level, and the "up" function of the work platform 22 is enabled. The trailer personnel lift 20 also permits slight shifts in the trailer after leveling by allowing the personnel lift to function within a larger range of level after the start-up sequence.

The microprocessor 70 described may be a general purpose programmable microprocessor of a type well known to those skilled in the art. Furthermore, such a microprocessor may be programmed by a programmer of ordinary skill to accept the inputs, perform the functions, and provide the outputs required for operation of the present invention, given the description contained herein.

While this invention has been described in detail with particular reference to preferred embodiments thereof, it shall be understood that variations and modifications can be effected within the spirit and scope of the invention as described hereinbefore and as defined in the appended claims. For example, although the lock-out device of the trailer personnel lift 20 is described with reference to disabling the "up" function of the trailer personnel lift, it is to be understood that the lock-out device could be used to shut down all or some of the functions of the lift system.

The embodiments of the invention in which an exclusive property or privilege is claimed are defined as follows:

1. A personnel lift comprising:

a base;

a vertical lift assembly defining upper and lower ends, the lower end being attached to the base;

an aerial work platform attached to the upper end of the vertical lift assembly;

a lift system for extending the vertical lift assembly and raising the aerial work platform;

a plurality of manually-set outriggers that are individually operator-actuated for stabilizing the base;

a level-sensing system for determining the magnitude and direction of tilt of the personnel lift and, based on that magnitude and direction information, determines which of the plurality of outriggers needs to be changed in elevation so as to level the personnel lift; and a level-indicator display linked to the level-sensing system, the level-indicator display including a plurality of indicators corresponding to the plurality of outriggers, the indicators displaying a first signal if the corresponding outrigger needs an elevation change, and a second signal if the outrigger does not need to be changed in elevation.

2. The personnel lift of claim 1, wherein the personnel lift is mounted on a trailer.

3. The personnel lift of claim 1, wherein the level-indicator display comprises a representation of the personnel lift.

4. The personnel lift of claim 1, wherein an elevation change comprises lowering of the outrigger.

5. The personnel lift of claim 1, wherein the level-sensing system comprises a tilt sensor and a microprocessor.

6. The personnel lift of claim 5, wherein the tilt sensor comprises a dual axis, signal-conditioned tilt sensor.

7. The personnel lift of claim 1, wherein each of the outriggers are mounted on a separate outrigger arm that is capable of locking into at least three positions, a first position in which the outrigger arm extends substantially horizontal to the surface upon which the personnel lift is to be located, a second position in which the outrigger arm extends substantially vertically from the base, and a third position that is intermediate of the first and second positions, each respective outrigger being adjustable away from and toward the ground in the first and third positions, the third position being selected so that the outrigger may be stabilized on an upward slope.

8. The personnel lift of claim 1, wherein the second signal must be displayed for all indicators for the lift system to operate.

9. The personnel lift of claim 8, wherein the display of the second signal requires the level-sensing system to determine the level of the personnel lift within a first range, and wherein the lift system is enabled to operate until the level-sensing system determines the personnel lift has fallen outside of a second range, the second range being greater than the first range.

10. A method of leveling a personnel lift comprising: providing a personnel lift comprising:

a base;

a plurality of manually-set outriggers for stabilizing the base;

a level-sensing system for determining the magnitude and direction of tilt of the personnel lift and, based on that magnitude and direction information, determining which of the plurality of outriggers needs an elevation change so as to level the personnel lift; and a level-indicator display linked to the level-sensing system, the level-indicator display including a plurality of indicators corresponding to the plurality of outriggers, the indicators displaying a first signal if the corresponding outrigger needs an elevation change, and a second signal if the outrigger does not need an elevation change; and manually changing individually by operator actuation the outriggers that correspond to the indicators displaying the first signal until all outriggers display the second signal.

11. A personnel lift comprising:

a base;

a vertical lift assembly defining upper and lower ends, the lower end being attached to the base;

a aerial work platform attached to the upper end of the vertical lift assembly;

a lift system for extending the vertical lift assembly and raising the aerial work platform; and a level-sensing system for determining the magnitude and direction of tilt of the personnel lift, said level-sensing system comprising a lock-out device for (1) enabling the lift system if the level-sensing system determines the personnel lift is leveled during a start-up operation to within a first range, and (2) disabling the lift system if the level-sensing system determines the personnel lift has fallen outside of a second range, the second range being greater than the first range.

12. A personnel lift comprising:

a base;

a vertical lift assembly defining upper and lower ends, the lower end being attached to the base;

an aerial work platform attached to the upper end of the vertical lift assembly;

a lift system for extending the vertical lift assembly and raising the aerial work platform;

a plurality of outrigger arms attached to the base, each of the outrigger arms being capable of locking into at least three positions, a first position in which the outrigger arm extends substantially horizontal to the surface upon which the personnel lift is to be located, a second position in which the outrigger arm extends substantially vertically from the base, and a third position that is intermediate of the first and second positions; and a plurality of outriggers corresponding to the plurality of outrigger arms, one of said outriggers attached to a distal portion of each of said plurality of outrigger arms, the outriggers being manually adjustable away from and toward the ground when the outrigger arms are in each of the first and third positions, the third position being selected so that the respective outrigger may be stabilized in the third position on an upward slope.

13. The personnel lift of claim 12, wherein the personnel lift is mounted on a trailer.

14. The personnel lift of claim 12, further comprising:

a level-sensing system for determining the magnitude and direction of tilt of the personnel lift and, based on that magnitude and direction information, determines which of the plurality of outriggers needs to be changed in elevation so as to level the personnel lift; and a level-indicator display linked to the level-sensing system, the level-indicator display including a plurality of indicators corresponding to the plurality of outriggers, the indicators displaying a first signal if the corresponding outrigger needs an elevation change, and a second signal if the outrigger does not need to be changed in elevation.

15. The personnel lift of claim 14, wherein the level-indicator display comprises a representation of the personnel lift.

16. The personnel lift of claim 14, wherein an elevation change comprises lowering of the outrigger.

17. The personnel lift of claim 14, wherein the level-sensing system comprises a tilt sensor and a microprocessor.

18. The personnel lift of claim 14, wherein the second signal must be displayed for all indicators for the lift system to operate.

19. The personnel lift of claim 18, wherein the display of the second signal requires the level-sensing system to determine the level of the personnel lift within a first range, and wherein the lift system is enabled to operate until the level-sensing system determines the personnel lift has fallen outside of a second range, the second range being greater than the first range.

* * * * *

UNITED STATES PATENT AND TRADEMARK OFFICE

CERTIFICATE OF CORRECTION

PATENT NO. : 5,934,409

DATED : August 10, 1999

INVENTOR(S) : S.D. Citron et al.

It is certified that error appears in the above-identified patent and that said Letters Patent is hereby corrected as shown below:

| COLUMN | LINE | |
|---|---|---|
| 12 (Claim 10, line 2) | 19 | after "comprising" the paragraph should break; the next line, beginning with "providing..." should be indented |
| 12 (Claim 11, line 5) | 44 | "a" should read --an-- |
| 13 (Claim 14, line 4) | 21 | "determines" should read --determining-- |

Signed and Sealed this

Eighteenth Day of April, 2000

*Attest:*

Q. TODD DICKINSON

*Attesting Officer*

*Director of Patents and Trademarks*